US007743775B2

(12) United States Patent
Thiebaut

(10) Patent No.: US 7,743,775 B2
(45) Date of Patent: Jun. 29, 2010

(54) MULTI-CONTAINER DEVICE FOR PACKAGING AND DISPENSING PRODUCTS AND METHOD FOR APPLYING MAKE-UP USING SUCH A DEVICE

(75) Inventor: Laure Thiebaut, Clichy (FR)

(73) Assignee: L'Oreal, Paris (FR)

( * ) Notice: Subject to any disclaimer, the term of this patent is extended or adjusted under 35 U.S.C. 154(b) by 695 days.

(21) Appl. No.: 11/484,684

(22) Filed: Jul. 12, 2006

(65) Prior Publication Data

US 2007/0017543 A1 Jan. 25, 2007

Related U.S. Application Data

(60) Provisional application No. 60/697,958, filed on Jul. 12, 2005.

(30) Foreign Application Priority Data

Jul. 25, 2005 (FR) ..... 05 07897

(51) Int. Cl.
*A45D 33/00* (2006.01)
*A45D 33/24* (2006.01)
*A45D 33/20* (2006.01)

(52) U.S. Cl. ..... 132/294; 132/287; 132/293

(58) Field of Classification Search ..... 132/293–297, 132/287; 401/263, 125, 123; 206/362.3, 206/15.3; 220/367.1, 521
See application file for complete search history.

(56) References Cited

U.S. PATENT DOCUMENTS

| | | | | |
|---|---|---|---|---|
| 3,760,820 | A * | 9/1973 | Seidler | 132/317 |
| 5,992,427 | A * | 11/1999 | Playe | 132/317 |
| 6,334,727 | B1 | 1/2002 | Gueret | |
| 6,491,041 | B1 * | 12/2002 | Okamoto | 132/74.5 |
| 6,694,987 | B2 | 2/2004 | Thiebaut | |
| 7,083,354 | B2 * | 8/2006 | Byun | 401/263 |
| 2003/0154996 | A1 * | 8/2003 | Bourjal | 132/293 |
| 2005/0109660 | A1 | 5/2005 | Karoly | |
| 2006/0169298 | A1 | 8/2006 | Thiebaut | |

FOREIGN PATENT DOCUMENTS

| | | |
|---|---|---|
| DE | 93 03 482 U1 | 5/1993 |
| EP | 1 382 541 | 1/2004 |

OTHER PUBLICATIONS

U.S. Appl. No. 11/688,828, filed Mar. 20, 2007, Thiebaut.
U.S. Appl. No. 12/197,010, filed Aug. 22, 2008, Thiebaut.

* cited by examiner

*Primary Examiner*—Robyn Doan
(74) *Attorney, Agent, or Firm*—Oblon, Spivak, McClelland, Maier & Neustadt, L.L.P.

(57) ABSTRACT

Device for packaging and dispensing products having a first container (2) for a first product, at least one second container (7) for a second product, which is designed to be assembled removably to the first container, this second container having an opening to allow the second product contained in the second container to be taken up, and a product applicator (14) configured in such a way as to be assembled removably to the second container so as to close off said opening.

15 Claims, 7 Drawing Sheets

MULTI-CONTAINER DEVICE FOR PACKAGING AND DISPENSING PRODUCTS AND METHOD FOR APPLYING MAKE-UP USING SUCH A DEVICE

REFERENCE TO PRIOR APPLICATIONS

This application claims priority to U.S. provisional application 60/697,958 filed on 12 Jul. 2005, and to French patent application No 05 07 897 filed on 25 Jul. 2005, both incorporated herein by reference.

FIELD OF THE INVENTION

The invention relates to devices for packaging and dispensing several products and, more particularly but not exclusively, devices designed to contain and dispense cosmetic or care products.

Additional advantages and other features of the present invention will be set forth in part in the description that follows and in part will become apparent to those having ordinary skill in the art upon examination of the following or may be learned from the practice of the present invention. The advantages of the present invention may be realized and obtained as particularly pointed out in the appended claims. As will be realized, the present invention is capable of other and different embodiments, and its several details are capable of modifications in various obvious respects, all without departing from the present invention. The description is to be regarded as illustrative in nature, and not as restrictive.

BACKGROUND OF THE INVENTION

Certain cosmetic or care products are designed to be used in combination. Thus, two-product and even multi-product containers have been proposed, i.e. containers comprising compartments containing the various products designed to be applied successively so as to interact, a product applied subsequently supplementing or improving the action of a product applied first.

In this regard, two-component mascaras are known which comprise an extending or thickening base over which is applied the mascara itself, to obtain a desired colour. It is also known to combine a moisturizing lipstick with a gloss to improve the staying power of the lipstick. Likewise, the combination of a nail varnish with a varnish curing base has been proposed with a view to strengthening the nail varnish.

In the prior art, various kinds of multi-compartment containers may be used to store and dispense products which have a complementary action.

Reference may be made in this regard to document WO 03/020440 which describes a device comprising a first container for a first product, a capping means for the first container which has an applicator for applying the first product and which comprises a second container for a second product, and a lid having a second applicator for applying the second product. The capping means is fixed, by screwing, to the first container while the lid is screwed onto a screw thread made at an open end of the capping means.

Such a packaging device is essentially designed to contain and apply liquid products. It is generally unsuitable for the application of products in solid or powder form.

Reference may also be made to patent application EP-A-1 382 541 which describes another type of two-compartment product packaging device comprising a first container for a first product, for example a liquid product, and a capping means for the first container which also comprises a second container for a second product, different to the first product, for example in the form of a powder. The capping means is screwed onto the first container, while a removable cover is assembled, also by screwing, to the second container to close it.

Although this kind of packaging device can be used to dispense products in various forms, for example in the form of a fluid product and a powder, it has a number of drawbacks. First, the first container has an applicator which also is used, in one embodiment, as an applicator for applying the product contained in the second container. There is no provision to give the device an applicator specifically for the second product. In any event, in order to apply the second product, it is necessary to remove the capping means to gain access to the applicator with which the first container is provided.

In addition to the abovementioned drawbacks, the devices mentioned above are relatively awkward to use as all the components of the device are assembled by screwing, such that the procedure required to assemble or, conversely, separate the various parts is relatively tricky. For example, to separate the first container from the capping means, the capping means must be twisted relative to the first container. To access the second container, the cover must be twisted relative to the capping means. In each case, it is necessary to manipulate the first container or the cover, on the one hand, and the second container, on the other hand. If the device is not securely gripped, one container may be opened instead of the other.

Lastly, reference may be made to patent FR 2 820 293 which describes an applicator for make-up products comprising a container with a solid block, for example a block of eyeshadow, and a capping means with an applicator. This capping means is used to take up and apply the product.

Although this document proposes an applicator for taking up and applying a solid product, the kit described in this document is not designed to contain different products.

OBJECTS OF THE INVENTION

In light of the above, there is a need for a multi-compartment device for packaging and dispensing products which overcomes the abovementioned drawbacks and which is able to contain products in various forms, for example fluid and solid or fluid and powder, while providing an applicator for the solid or powder product which is easy to use.

SUMMARY OF THE INVENTION

The invention thus relates, according to a first aspect, to a device for packaging and dispensing products, in particular cosmetic products, comprising a first container for a first product, at least one second container for a second product, which is designed to be assembled removably to the first container, this second container comprising an opening to allow the second product contained in the second container to be taken up, and a product applicator configured in such a way as to be assembled removably to the second container so as to close off said opening.

According to a general feature of this device, the product applicator is assembled in such a way that it can move transversely with respect to a geometrically longitudinal axis of the first and second containers.

The second container thus has a specific applicator which can easily be moved simply by sliding it sideways to close off the second container or, conversely, be used to apply the second product.

Moreover, it is preferred that the procedure required to remove the applicator is fundamentally different to that needed to open the first container, so that there is no risk of making a mistake.

DETAILED DESCRIPTION OF THE PREFERRED EMBODIMENTS

Figure 1:
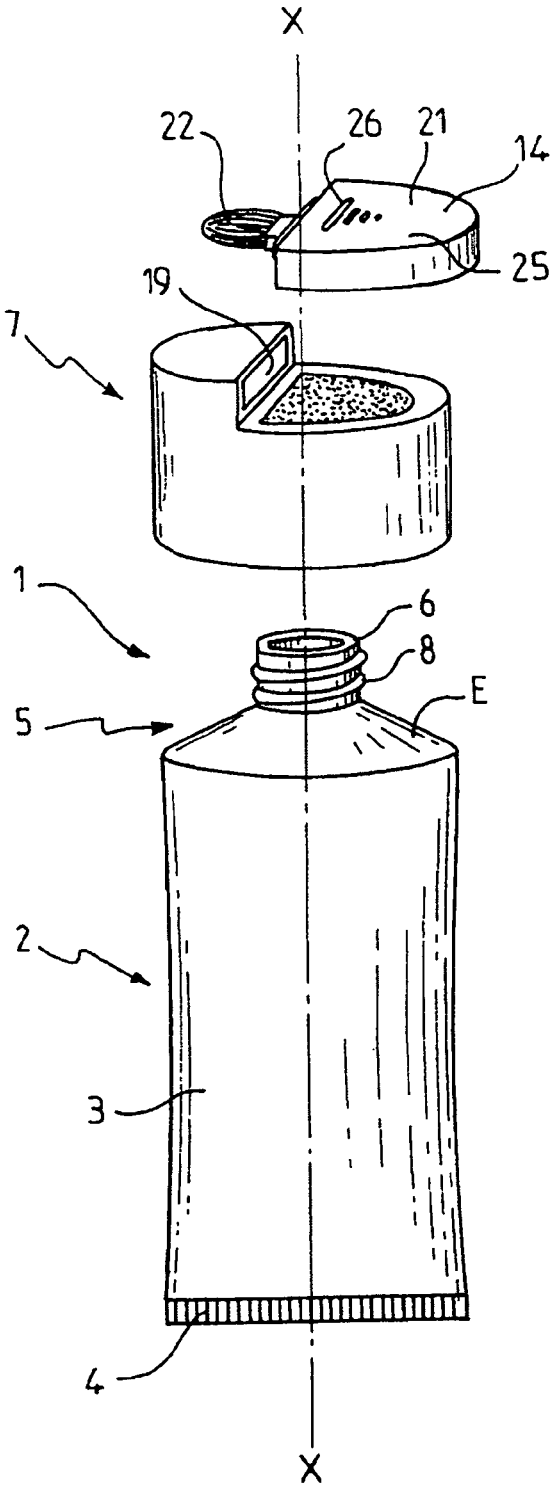
FIG. 1 is a front view of a device for packaging and dispensing products according to the invention, separated into its various parts.

In a first embodiment of the device according to the invention, the first container consists of, consists essentially of, or comprises, a tube having a first end which is closed and an opposite end which is open, forming a neck to which the second container is assembled.

For example, the neck of the tube and the second container may comprise complementary screw threads for assembling the second container to the first container by screwing.

In a variant, the first container consists of, consists essentially of, or comprises, a pressurized container with a dispensing valve, filled with a propellant gas.

In this case, for example, the first container and the second container comprise complementary snap-fastening means.

According to yet another variant, the first container may have dispenser such as a pump or piston, etc. for dispensing the product.

According to one feature of the invention, the second container comprises a compartmentalized body delimiting a first compartment and a second compartment, which are juxtaposed, the first compartment being designed to contain the second product and having a first opening extending substantially in a transverse plane with respect to the geometric axis of the second container, the second container having a second opening extending in a plane perpendicular to the plane of the first opening so as to receive an applicator element of the applicator.

For example, the end surface of the second container is stepped and comprises a first step in which the first compartment is formed and a second step in which the second compartment is formed.

As regards the applicator, this preferably comprises a handle to which the applicator element is secured, the handle and the body of the second container having complementary external shapes in such a way that when the applicator element is inserted in the second compartment, the external surface of the handle lies flush with the external surface of the body.

In one embodiment, the body and the applicator are configured so that the applicator is fixed removably in the second compartment by snap-fastening or friction.

In one particular embodiment, the device comprises a compartmentalized body which is designed to be assembled removably to the first container and which comprises a first part in which the or each second container is or are made, and a second part in which the or each second container open(s) out and which comprises a housing for the applicator.

For example, it comprises a cover which can move with respect to the body between an open position in which the applicator is accessible from the outside and a closed position, and a cap for closing the cover, in particular by snap-fastening or friction.

Advantageously, the applicator and the base of the housing comprise complementary structure for holding the applicator in the second compartment.

These holding arrangements preferably comprise for example at least one stud provided in the cover and at least one corresponding hole made in the applicator, in which the stud engages when the cover is closed.

They may also comprise a stud and a recess, one provided in the base of the second compartment and the other in the applicator.

The applicator element may consist of, consist essentially of, or comprise, any applicator appropriate for the envisaged use, such as a foam tip, a flocked applicator tip, a brush or a comb.

Likewise, the cap may be made from any suitable material. However, it is preferably made as a single piece by moulding a plastic.

The device according to the invention may be used to hold products in any of unlimited various forms. Thus, for example, the first product may be a cake of solid material. The first product may also be in fluid form. The first container may in this case comprise an application surface through which the first product is dispensed.

However, in an advantageous application, the first product is a fluid product, the second product being a powder. For example, this powder may be a powder compact containing anti-wrinkle active ingredients.

According to a second aspect, the invention also relates to a method for applying make-up using cosmetic products contained in a device for packaging and dispensing products which comprises a first container containing a first product, at least one second container containing a second product, which is designed to be assembled removably to the first container, this second container having an opening to allow the second product contained in the second container to be taken up, and a product applicator configured in such a way as to be assembled removably to the second container so as to close off said opening, the method comprising applying the product contained in the second container, by opening the second container and applying said product using the applicator, and applying the first product, by opening the first container and applying said first product, wherein the second container is opened by moving the product applicator by sliding it transversely with respect to a geometric longitudinal axis of the first and second containers.

According to another aspect, the invention also relates to a device for packaging and dispensing at least one product, in particular a cosmetic product, comprising at least one container for at least one product, a closure for the container which is designed to be assembled removably to the container, and at least one product applicator configured in such a way as to be mounted removably, at least partially, in the closure, wherein said at least one product applicator and the closure are designed in such a way that said at least one applicator is mounted transversely in the closure with respect to a geometric longitudinal axis of the container.

In one embodiment, the closure for the container comprises a body having inside it a housing for receiving the applicator and an opening oriented generally transversely for the insertion of the applicator in the housing.

Preferably, the body of the closure comprises an applicator guide.

This guide preferably comprises for example a slope extending towards the opening in the direction of the internal housing.

Advantageously, the slope has snap-fastening structure and ability for interacting with complementary snap-fastening structure and ability provided on the applicator.

The body may also be provided with a stop for limiting the movement of the applicator relative to the body, in the direction of insertion of the applicator into the housing.

According to yet another aspect, the invention also relates to a method for applying make-up using at least one cosmetic product contained in a packaging and dispensing device which comprises at least one container for at least one product, a closure for the container which is designed to be assembled removably to the container, and at least one product applicator configured in such a way as to be mounted removably, at least partially, in the closure, the method comprising opening the container and applying the product using the applicator, wherein the applicator is removed from the closure by sliding it transversely with respect to a geometric longitudinal axis of the first and second containers.

Further aims, features and advantages of the invention will emerge on reading the following detailed description of the Figures, provided merely by way of non-limiting example, with reference to the attached drawings.

Figure 2:
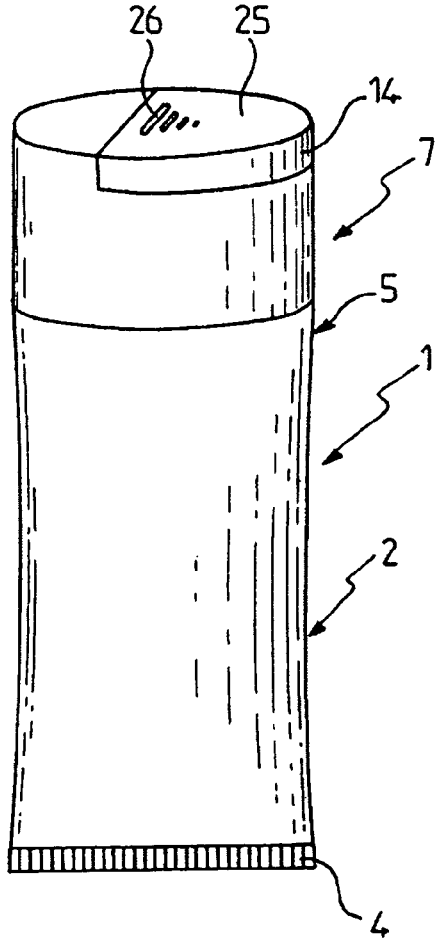
FIG. 2 is a front view of the device of FIG. 1, in the assembled state.

FIGS. 1 and 2 herein show a first embodiment of a device for packaging and dispensing products according to the invention, designated by the general reference number 1.

It has a longitudinal axis X-X', assumed to be vertical.

The device 1 comprises-a first container 2 in the form of a tube made by moulding an elastically deformable plastic, for example polyethylene. This first container is designed to contain a first product.

The tube comprises a body 3 and has a first lower end 4 sealed by heat-welding along a line running transversely to the longitudinal axis X-X', and an opposite open end 5 forming a neck 6.

At this end region 5, the tube 2 has a shoulder E which is generally frustoconical and runs from the peripheral wall of the tube to the neck 6.

The device 1 also comprises a second container 7 forming a cap which is assembled by screwing on a screw thread 8 made on the outer peripheral surface of the neck 6. This second container is designed to contain a second product which differs from the first product.

In this regard, the cap 7 comprises a cap body 9 which has a cylindrical outer peripheral skirt 10 whose shape is complementary to the shape of the tube 2 in such a way that, when assembled, the outer peripheral wall of the cap body lies in the extension of the wall of the tube 3.

The cap body 9 also comprises, in the embodiment shown, a cylindrical inner skirt 11 having on the inside a screw thread 12 able to interact with the screw thread 8 on the neck 6.

Figure 4:
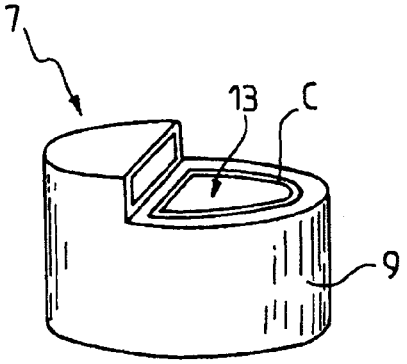
FIG. 4 shows a variant of the second container of a device for packaging and dispensing products according to the invention.

The cap 7 is divided into compartments and comprises a first compartment 13, for the second product, closed by a sealing cover 14, and a second compartment 15 which receives the cover 14. However, as can be seen in FIG. 4, the second product may be placed in a dish C borne by the body 9.

The first compartment 13 has an opening which extends in a horizontal plane, i.e. perpendicular to the axis X-X'. The second compartment 15 has an opening which extends in a vertical plane, i.e. parallel to the axis X-X'.

As for the cover 14, it constitutes an applicator used to take up and apply the second product.

Figure 3:
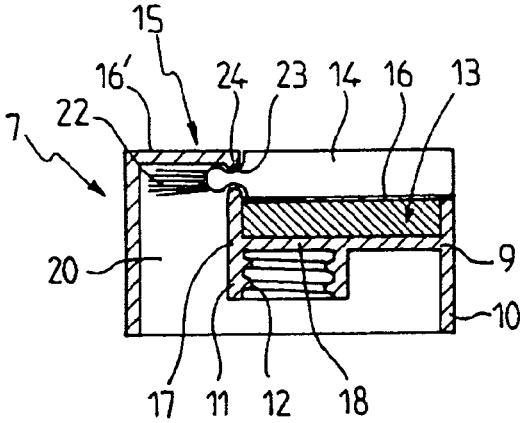
FIG. 3 is a view in section of the second container and its applicator.

With reference to FIG. 3, which shows the cap 7 on its own, the compartments 13 and 15 are arranged side by side. The cap body 9 comprises a stepped upper end surface which delimits a first step 16 and a second step 16'. The first step is set back from the second step, i.e. at a lower level. The first and second steps 16 and 16' are separated, axially, by a distance corresponding generally to the thickness of the applicator 14. The compartments 13 and 15 are also separated laterally by a wall element 17 projecting vertically inside the cap body 9 between two regions of the outer skirt 10 which are symmetrical about a diameter of the skirt 10. Moreover, the first compartment 13 has a wall element 18 arranged transversely to and set back from the end section of the outer skirt 10 and the partition wall 17.

Thus, the wall element 18, the upper end region of the external skirt 10 and the partition wall 17 delimit the first compartment 13.

To give the second container 7 a greater capacity, the partition wall 17 is offset in such a way that the surface area of the first step 16 is greater than the surface area of the second step 16'.

The steps 16 and 16' are separated by an open face 19 via which the space inside the second compartment 15 opens out. This face extends vertically between the first and second compartments, perpendicular to the plane of the opening of the first compartment 13. Thus, the volume 20 delimited, at the top, by the end surface of the cap body 9 and, laterally, by the outer skirt 10 and by the partition wall 17, constitutes a housing for receiving the applicator 14, in which the applicator is housed by sliding it sideways, in the same plane as the opening of the first compartment.

The applicator 14 comprises a handle 21 bearing an applicator element 22. The shape of the handle 21 is complementary to the shape of the first step 16 of the cap 7 and can thus be a portion of an ellipse or portion of a disc.

As regards the application member 22, this may comprise any element appropriate for the envisaged use.

In the example envisaged, the first product contained in the tube 3 is a fluid product, while the second product contained in the second compartment 13 is in the form of a powder compact.

Thus, the applicator 22 may be a foam tip, a flocked applicator tip, a brush or even a comb.

The applicator 14 preferably constitutes an element which can be detached from the capping means 7 into which it is mounted so as to close off the first compartment 13.

In the position of non-use, shown in FIG. 2, in which the handle 21 closes off the second container 13, the applicator element 22 is inserted in the volume 20 so as to protect it from dust or other dirt as well as to avoid dirtying items or articles with which it could otherwise come into contact. To ensure the assembly is secure, the handle 21 may have, in the area from which the applicator element 22 extends, localized indents, such as 23, in which corresponding reliefs 24 made on the cap body 9 can snap-fasten. Note, however, that effective assembly may also be ensured when the applicator is mounted in the cap body 9 by friction.

In this position, the upper end surface and the peripheral wall of the handle 21 lie flush with the upper end surface and peripheral wall of the cap body 9.

To take up and apply a measure of product from the second compartment 13, all one has to do is simply move the applicator 14 by sliding it sideways until the applicator element 22 emerges from the cap body 9. This movement may easily be performed by applying pressure with the thumb, reliefs 26 being provided on the upper surface 25 of the handle 21 to improve the grip.

Once it has been detached, the applicator can be used to apply the product.

As stated above, the device just described is particularly suitable for packaging and applying two products, one of which is in fluid form and the other in the form of a cake or powder compact, and which are designed to interact.

Thus, by way of example, the powder compact may contain anti-wrinkle active ingredients while the product contained in the tube 3 is a moisture-rich emulsion. The powder contained in the second container 13 may be applied first, just to the wrinkles, using the applicator 14. Owing to its texture, it will be visible after application in such a way that the areas where it is applied can be easily identified. Thanks to the applicator, the powder accumulates in the folds of the wrinkles. After applying the powder, the second compartment 13 is closed using the applicator. The capping means 7 is then unscrewed and a measure of emulsion is taken from the bottle 3. The emulsion can then be applied by massaging into the areas where the powder has already been applied. This massaging action spreads the powder evenly. Moreover, thanks to the moisture supplied by the emulsion, combined with the massage, the active ingredients are released in the depths of the wrinkle and the powder can no longer be seen.

Note that the invention is not limited to the embodiment described.

In the embodiment described above with reference to FIGS. 1 to 4, the first container is a tube with elastically deformable walls.

It is also possible to combine a pressurized container with a closure having a second container, similar to the cap described above.

Figure 5:
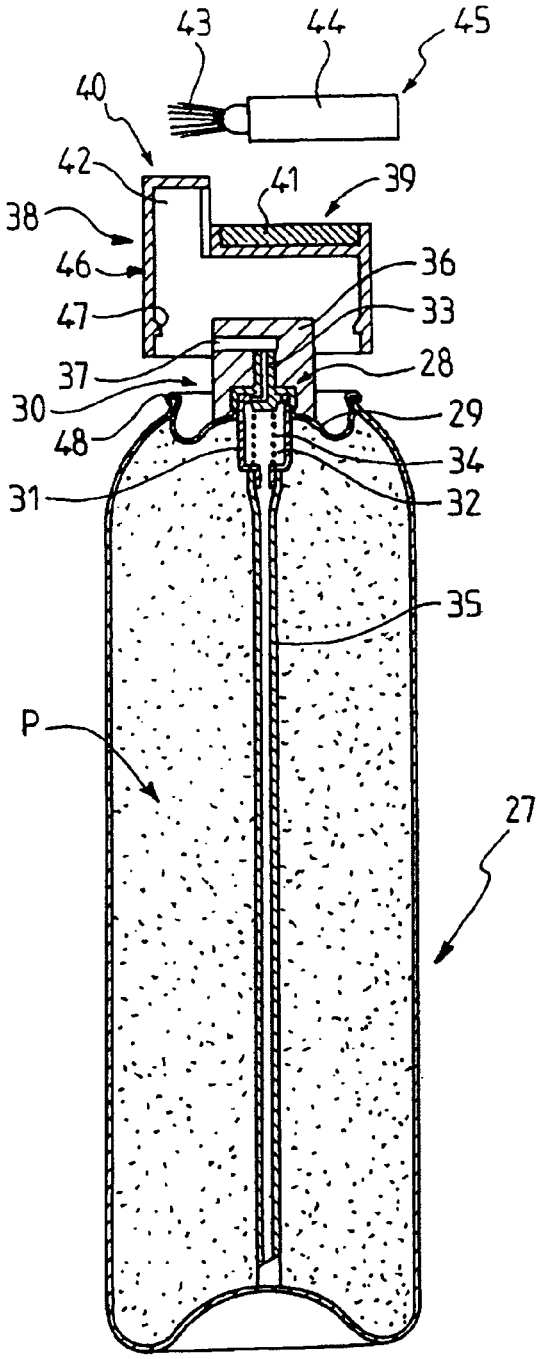
FIG. 5 shows another embodiment of a device for packaging and dispensing products according to the invention.

Thus, in the variant shown in FIG. 5, the packaging and dispensing device comprises a pressurized container 27 containing a product to be sprayed and a propellant gas and having a valve 28 fixed for example by crimping to a dish 29 crimped onto the open upper end 30 of the body of the container.

As with the embodiment described above, the container 27 has a geometric longitudinal axis X-X' corresponding to the general axis of symmetry of the container body.

In a manner known per se, the valve 28 comprises a valve body 31 defining inside it a chamber 32 in which a valve stem 33 is mounted in such a way that it can move axially between a valve-closed position and a valve-open position. A spring 34 biases the valve stem 33 towards the closed position. The chamber 32 is in communication with a dip tube 35 which extends axially into the body of the container 27.

Moreover, the valve has a push-button 36 with an internal duct 37 communicating with a corresponding duct made in the valve stem 33. The device shown in FIG. 5 also has a lid 38 similar to the cap 7 described above with reference to FIGS. 1 to 4, and comprises two parts 39 and 40, one forming a second container 41 for housing a second product and the other a space 42 for housing an applicator element 43, identical to the applicator of FIGS. 1 and 3, borne by a handle 44 of an applicator 45.

However, in the variant envisaged, the lid 38 is assembled to the first container 27 by snap-fastening and therefore does not have an inner skirt.

By contrast, the lid 38 has an outer skirt 46 having on the inside an annular bead 47 which snap-fastens over an annular relief 48 formed when the dish 29 is crimped onto the body 27 or made using an intermediate part.

Figure 6:
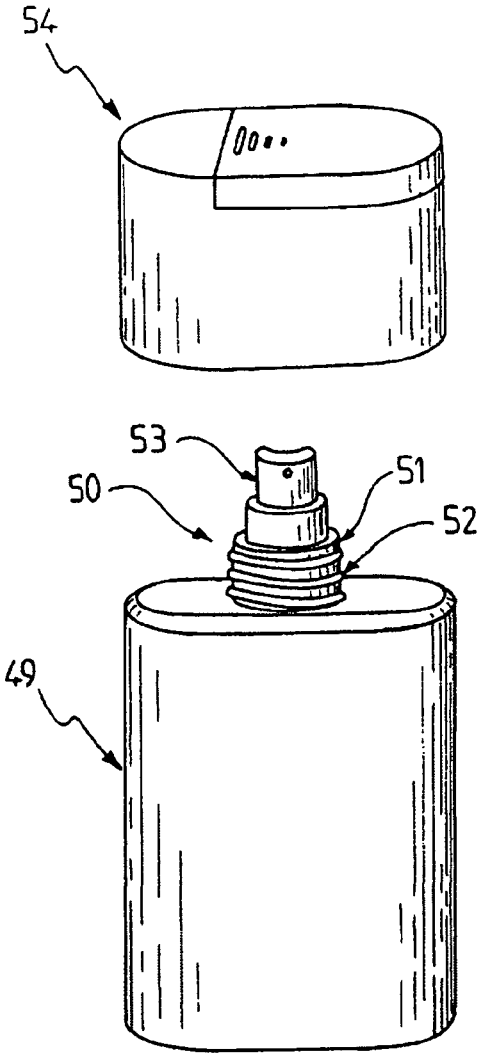
FIG. 6 shows another embodiment of a device for packaging and dispensing products according to the invention.
Figure 7:
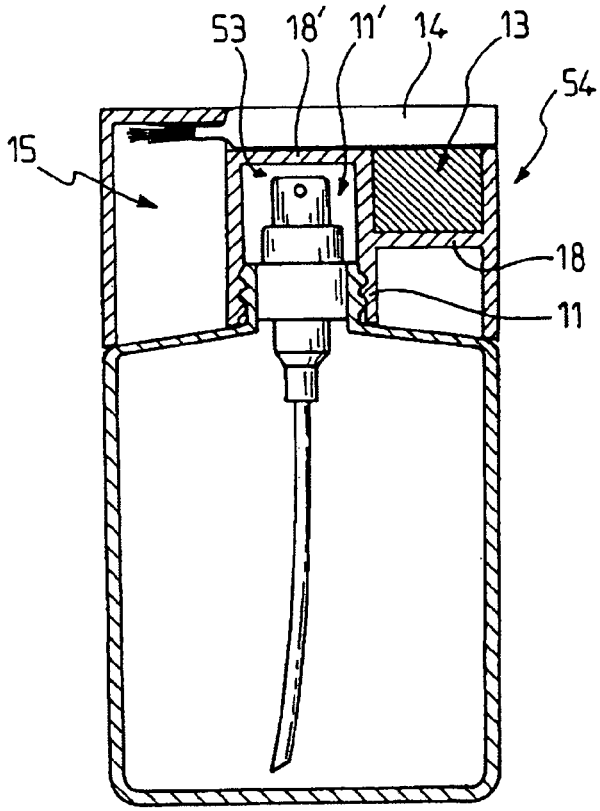
FIG. 7 is a view in section of the device of FIG. 6.

According to yet another variant, shown in FIGS. 6 and 7, the packaging and dispensing device comprises a first container 49 made in the form of a bottle formed by blow-moulding a plastic, for example polypropylene, which also contains a fluid product and which has an open upper end 50 having a neck 51 with a screw thread 52 on the outside, and on which is mounted a conventional pump 53 for taking up the product contained inside the first container. The device also comprises a lid 54 which is screwed onto the screw thread 52 on the neck 51.

The bottle also has a geometric axis X-X' running perpendicularly to the base of the bottle.

As shown in FIGS. 6 and 7, in which elements identical to the elements in FIGS. 1 to 3 bear the same reference numbers, the lid 54 also has an outer peripheral skirt 10 whose shape is complementary to the shape of the container 49 and an inner skirt 11 with an internal screw thread able to interact with the screw thread 52 of the neck.

The inner skirt 11 delimits internally a housing 11' shaped in such a way as to receive and house the pump 53. This housing is delimited radially by the skirt 11 and axially by an upper wall element 18' which lies in the same plane as the opening of the first compartment 13. The housings 13 and 15 are, in this embodiment, positioned on either side of the housing 11'. In other words, the inner skirt is offset transversely with respect to the compartment 13 and the upper wall 18' lies at an intermediate level between the base wall 18 of the first compartment and the upper wall of the second compartment and constitutes a bearing surface for the applicator 14.

Figure 8:
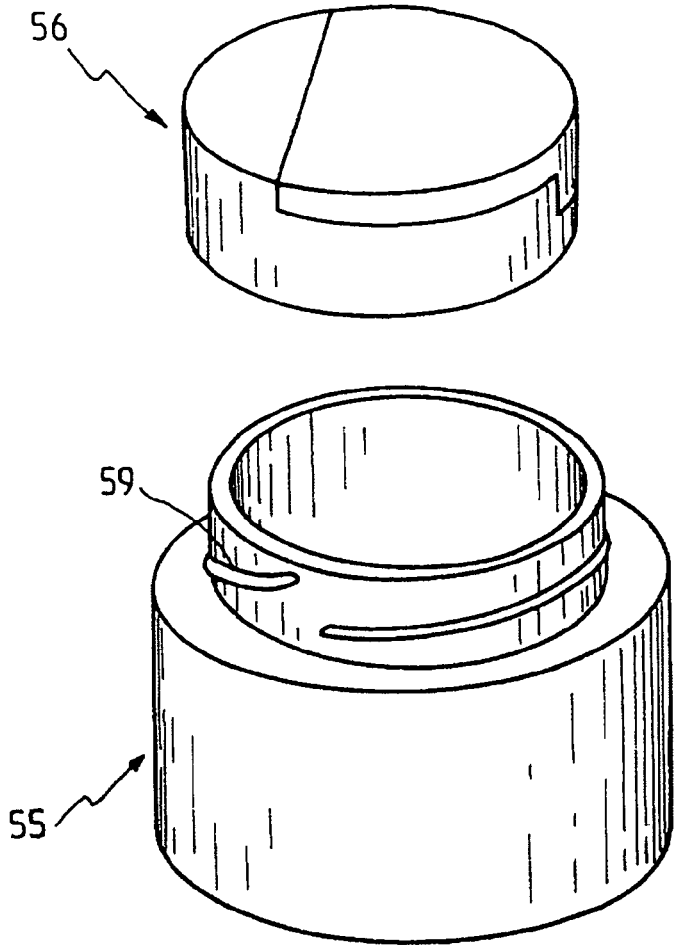
FIG. 8 shows yet another embodiment of a device according to the invention.
Figure 9:
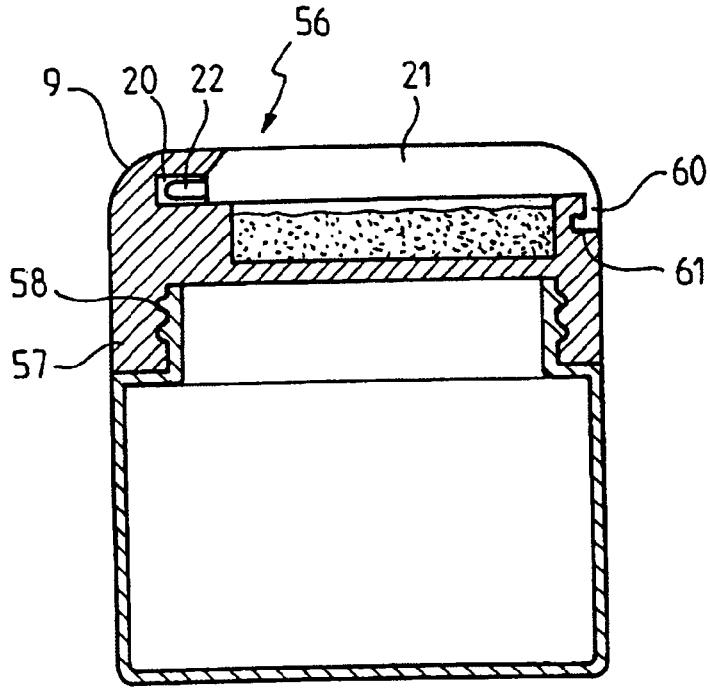
FIG. 9 shows a view in section of the device of FIG. 8.

As shown in FIGS. 8 and 9, as a variant, it is also possible to configure the first container 55 in the form of a jar designed to contain a cream or cake of cosmetic product, and onto which is screwed a lid similar to the cap described above with reference to FIGS. 1 to 4, but in which the inner and outer skirts are combined into a single skirt 57 having an internal screw thread 58 able to cooperate with a screw thread 59 on the container 55. This reduces the volume 20 for housing the applicator element 22 to the very minimum, limiting further the risk of the applicator element 22 becoming dirty. Moreover, to ensure the assembly is secure, the handle 21 of the applicator has, at its end opposite the applicator element 22, a projecting relief 60 with an end tooth, in the form of a hook, which snap-fastens into a corresponding hollow 61 made in the cap body 9. Such an assembly, by snap-fastening of the end of the handle, could also be envisaged in the embodiments described above. In the assembled position, the upper end surface and the peripheral wall of the handle 21 lie flush with the upper end surface and the peripheral wall of the cap body.

In the various variants envisaged, the first container comprises a general axis X-X' which extends along the length of the container or, in other words, transversely to a base wall or a weld line made at the base.

According to a feature of the invention, in these various embodiments the applicator can be inserted at least partially in the second container, so as to close off the compartment containing the second product, with a transverse movement, i.e. perpendicular to the axis X-X'.

Moreover, in the embodiments shown in FIGS. 1 to 4 and 7, the first container may also have an applicator, in the form of a perforated application surface or generally, through which the product can pass.

Lastly, note that, by virtue of the invention, according to which a first container is closed by a lid which bears a second container closed off by an applicator which can be moved by sliding it sideways, it is possible to have a user-friendly handle for the applicator while still having a fine, precise tip, at a lower cost.

Note also that, during use, the product is taken up by also moving the applicator transversely to the second container. It is thus possible to position the container very close to an area to which the product is to be applied, while moving the hand away from and offsetting it laterally to the area of application, allowing good visibility, particularly when the surface is viewed using a mirror.

Finally, it is understood that any risk of injury is eliminated because the device, which uses a detachable applicator to close off the second container, has no hinged cover which could, during use, impede and possibly scratch the user.

However, the invention is not limited to the embodiment described.

Indeed, it would not be exceeding the scope of the invention if the second container were configured so as to include a cover designed to form a housing for one or more applicators.

FIGS. 11 to 14 show two embodiments of a device according to the invention in which the second container has such a cover.

A first embodiment of such a device will first be described with reference to FIGS. 11 and 12.

As can be seen in these figures, according to this variant, the device also comprises a first container 65 for a first product and a second container 66 for a second product.

The first container 65 has a first lower end 67 forming a base and an opposite end 68 with a neck 69 in which is mounted, for example by screwing, a conventional pump 70 having a dip tube 71 extending towards the base of the container 65.

The second container 66 also forms a lid which is assembled, in the embodiment illustrated, by screwing onto the neck 69.

To this end, as in the embodiment of FIG. 7, the lid 66 comprises an outer peripheral skirt 72 whose shape is complementary to the shape of the first container 65 and an inner skirt 73 having an internal screw thread able to interact with a screw thread 74 on the neck 69.

When the lid 66 is screwed onto the neck 69, the inner and outer skirts bear against an upper shoulder 75 of the first container 65, the inner skirt 73 forming a cap which closes off the pump 70.

Figure 11:
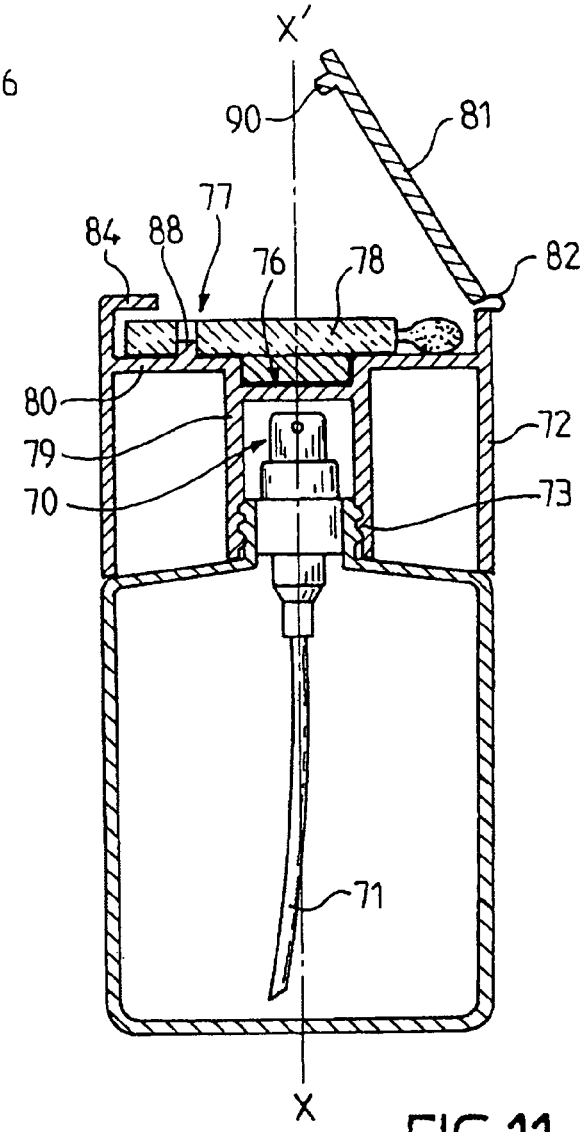
FIG. 11 is a view in section of the device of FIG. 10, in the partially closed state.
Figure 12:
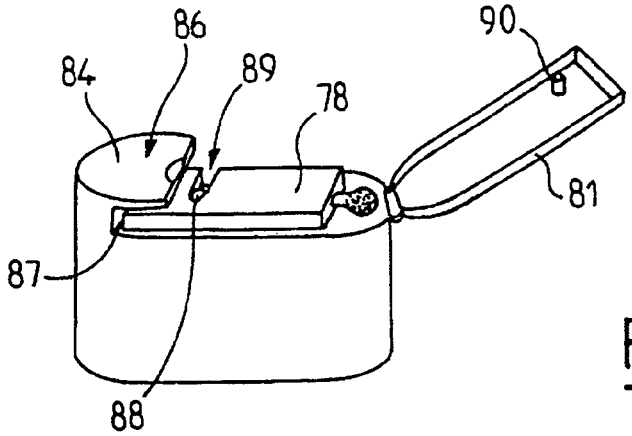
FIG. 12 is a perspective view of the closure means of the device of FIG. 10, in the open state.

As can be seen in FIG. 11, the lid 66 is divided into compartments.

In other words, it comprises a first part 76 with one or more containers, for example a single container, as shown, for the second product, and a second part 77 designed to receive one or more applicators, for example a single applicator 78 as shown.

The upper end surface of the lid 66 is stepped and has a central wall 79 and a peripheral transverse wall 80 which is axially offset with respect to the transverse wall 79 in such a way as to delimit the container for storing the second product.

The outer peripheral skirt 72 extends axially beyond the peripheral transverse wall so as to delimit a housing 77 in which the applicator 78 is placed.

Figure 10:
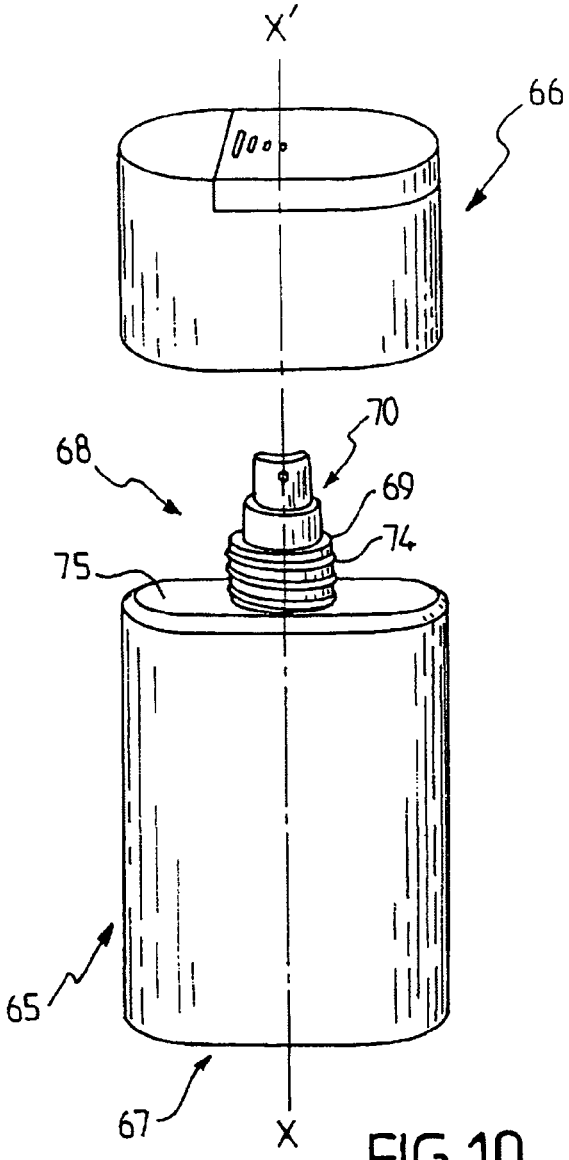
FIG. 10 shows another embodiment of a device according to the invention.

A cover 81, which can pivot by means of a hinge 82 between an open position, shown in FIG. 11, and a closed position, shown in FIG. 10, closes off the housing 77 to protect the applicator 78.

Note in this regard that the free end of the outer peripheral skirt 72 has, on the side opposite the hinge 82, a lip 84 forming a flat part 86 which delimits, with the peripheral transverse wall of the cover, a slot 87 for an applicator 78 to be inserted and guided transversely, i.e. perpendicularly to the general axis X-X' of the first container 65.

Note also that, for example, the device has additional means for holding and guiding the applicator in the housing 77. These holding means can be made in the form of a stud 88 projecting from the peripheral wall of the upper end surface of the cover 66, which is inserted in a recess 89 forming a hook made in the applicator 78 for the purpose of centering the applicator in the housing 77 while acting as a stop for limiting the transverse movement of the applicator.

For its part, the cover 81 has a stud 90 which is inserted in a corresponding hole made in the applicator 78.

Means will also be provided to keep the cover 81 closed, for example in the form of a snap-fastener.

Figure 14:
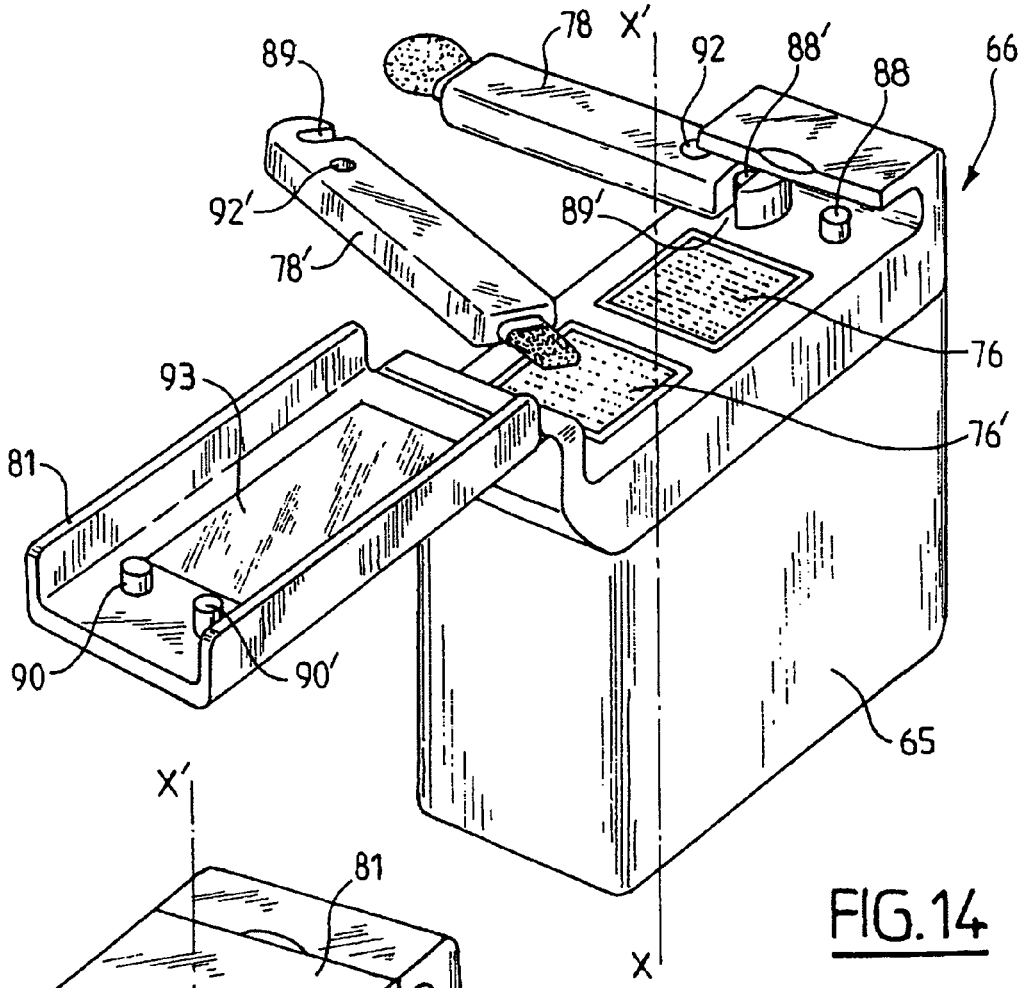
FIG. 14 is a perspective view of another embodiment of a device according to the invention, in the open state.
Figure 13:
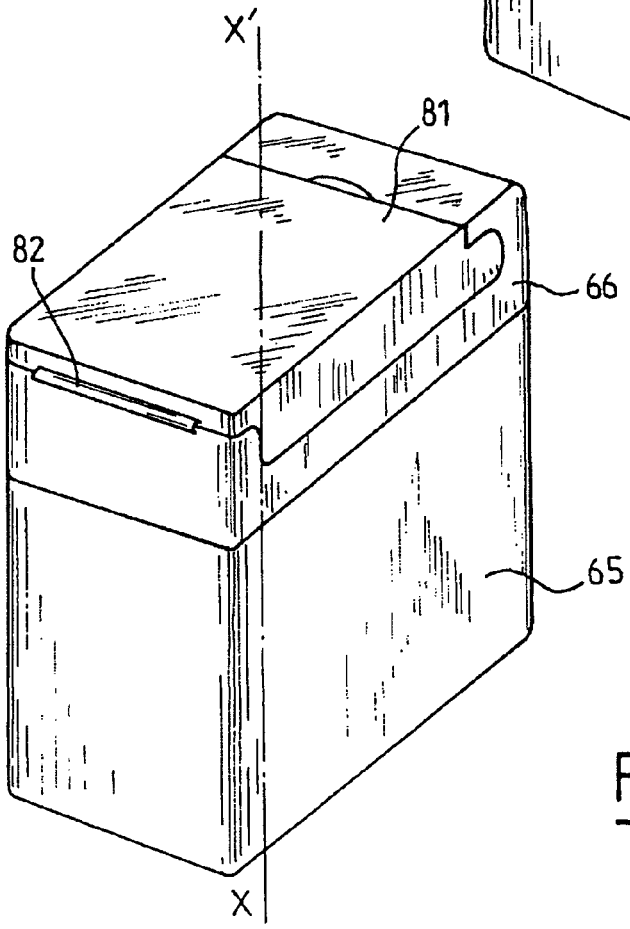
FIG. 13 is a perspective view of another embodiment of a device according to the invention, in the closed state.

Referring now to FIGS. 13 and 14, in which elements identical to the elements described with reference to FIGS. 11 and 12 bear the same reference numbers, it would not be exceeding the scope of the invention if the lid 66 were to comprise several containers 76 and 76' made in accordance with the teaching of FIG. 11, by giving the body of the lid 66 a compartmentalized structure.

Likewise, it would not be exceeding the scope of the invention if the upper part of the lid 66 were to delimit, when the cover 81 is closed, a housing able to receive two applicators 78 and 78'.

Naturally, in this case, the upper end surface of the lid 66 has two spikes 88 and 88' which engage in two recesses 89 and 89', respectively, made near one of the ends of the applicators.

Likewise, holes 92 and 92' will be made in each applicator, in which studs 90 and 90', borne by the inner face of the cover 81 engage, respectively.

Note that, as shown, this inner face may have a mirror 93.

Likewise, note that, in the embodiments of FIGS. 10 to 14, the shape of the first container may be for example cylindrical, with a round, oval or parallelepiped base.

Figure 15:
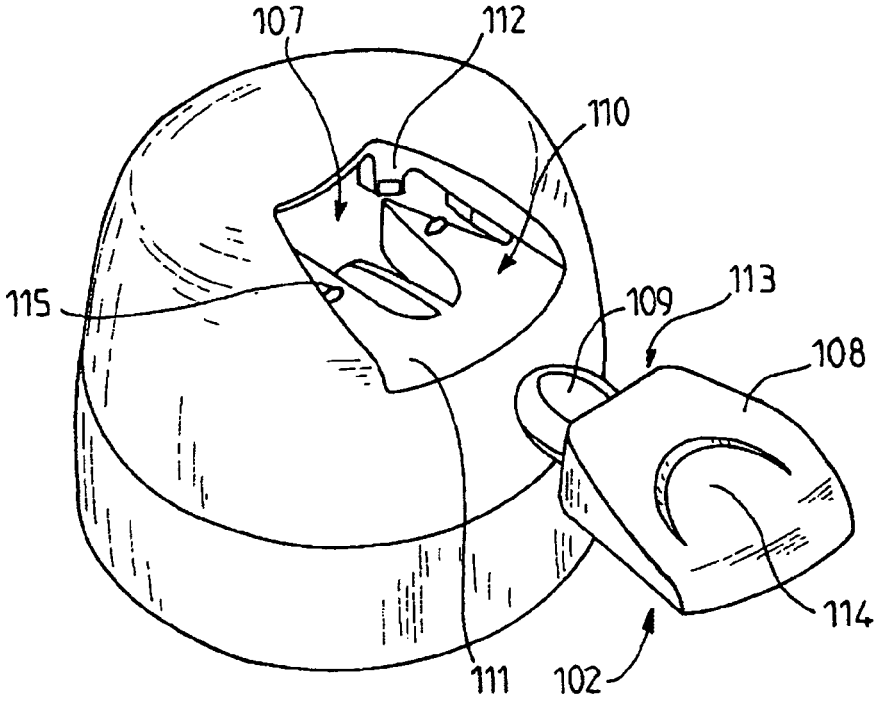
FIG. 15 shows yet another embodiment of a device according to the invention.
Figure 16:
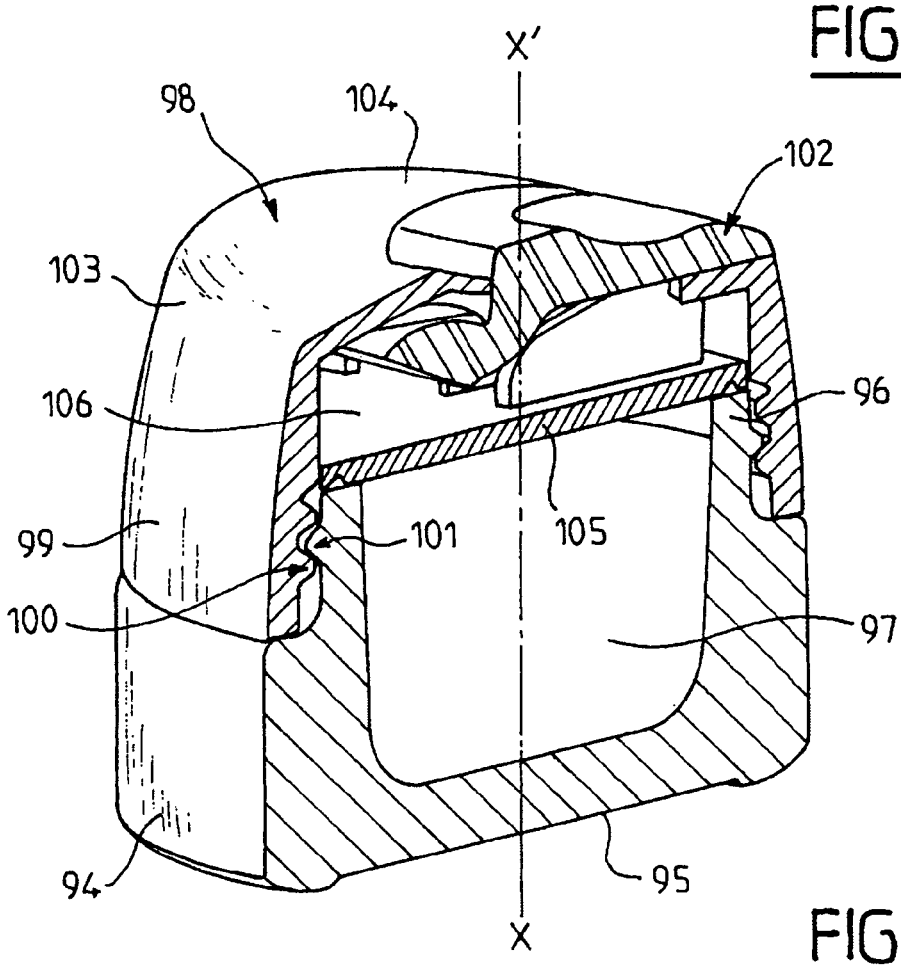
FIG. 16 is a view in section of the device of FIG. 15.

Another embodiment of a device for packaging and dispensing a product according to the invention will now be described with reference to FIGS. 15 and 16.

According to this embodiment, the device comprises a first container 94 having a closed lower end 95 and an open opposite end 96 forming a neck. This container 94 also comprises, as in the various embodiments envisaged, a general geometric axis X-X' which extends perpendicularly to the base 95 of the container and which forms, in the example shown, a general axis of axial symmetry for the container 94.

As shown, the container 94 has, on the inside, a housing 97 designed to receive a product.

The device also comprises an attached lid 98, which comprises a peripheral wall 99 having an internal screw thread 100 designed to interact with a complementary screw thread 101 made on the outside of the neck 96 of the container 94.

The device also comprises an applicator 102 which is used to take up the product contained in the housing 97 and apply it to a user's skin.

In accordance with the teaching of the invention, the applicator 102 and lid 98 are shaped in such a way that the applicator can be housed in a compartment 103 made in the lid 98, the movement for inserting the applicator in the lid and removing it therefrom being performed in a generally transverse direction, i.e. generally perpendicular to the general geometric axis X-X' of the container 94.

The lid 98 essentially has a body 103, made for example by moulding, which has a base 104 and the peripheral skirt 99. At an intermediate level, i.e. between the base 104 and the screw thread 100, the lid 98 has a transverse wall 105, for example covered with cardboard and force-fitted into the lid 98 so as to delimit the housing 106 for receiving the applicator 102.

The base 104 of the lid 98 also has an opening 107 allowing the applicator to be partially inserted in the housing 108. As can be seen, this opening is oriented generally transversely, with respect to the axis X-X', in such a way that the applicator is inserted with a movement comprising essentially a transverse component.

The applicator has a first part 108 forming a handle and a second part 109 consisting of a brush, foam tip or the like, which is designed to be placed in the housing 106 when not in use.

Near the opening, the lid 98 has an inclined seat 110 on which the handle 108 rests when the applicator is inserted in the lid. As can be seen in FIG. 15, the seat 110 comprises a base surface 111, extending generally transversely but essentially in an oblique direction, and an upright peripheral surface 112. In other words, the transverse surface 111 of the seat 110 forms a slope for guiding the applicator against which the applicator slides as it is inserted in the lid 98. The peripheral surface 112 thus forms a stop against which a flat front face 113 of the handle 108 bears.

Note that the external face of the handle 108 has a shape which is generally complementary to the shape of the external surface of the lid 98. Thus, the external surface of the handle 108 lies flush with that of the lid so as to give the whole an uninterrupted contour, an indent 114 being however made in the handle 108 to facilitate extraction of the applicator.

Advantageously, recesses may be provided on the base surface 111 of the seat 110 to make the lid less expensive to produce.

Moreover, snap-fastening means for holding the applicator in the lid will advantageously be provided, for example taking the form of lugs, such as 115, made on the seat 110, these lugs being designed to interact with corresponding notches made in the handle 108.

To use the device that has just been described, the user simply has to remove the lid 98, extract the applicator 108 from the housing 106, with a generally transverse movement, i.e. with a movement generally perpendicular to the general axis of the lid 98, take up a measure of product using the applicator and apply it to the skin. After use, the container 94 is closed again and the applicator inserted in the housing 106.

As in the various embodiments envisaged, the applicator can easily be extracted with a simple sideways sliding movement, making it particularly user-friendly.

As used herein, applying makeup means applying makeup to the usual places on the human body, including the hair, eyes, skin, lips, face, scalp, mucus membranes, integuments, etc.

The above written description of the invention provides a manner and process of making and using it such that any person skilled in this art is enabled to make and use the same, this enablement being provided in particular for the subject matter of the appended claims, which make up a part of the original description.

As used above, the phrases "selected from the group consisting of," "chosen from," and the like include mixtures of the specified materials. Terms such as "contain(s)" and the like as used herein are open terms meaning 'including at least' unless otherwise specifically noted.

All references, patents, applications, tests, standards, documents, publications, brochures, texts, articles, etc. mentioned herein are incorporated herein by reference. Where a numerical limit or range is stated, the endpoints are included. Also, all values and subranges within a numerical limit or range are specifically included as if explicitly written out.

The above description is presented to enable a person skilled in the art to make and use the invention, and is provided in the context of a particular application and its requirements. Various modifications to the preferred embodiments will be readily apparent to those skilled in the art, and the generic principles defined herein may be applied to other embodiments and applications without departing from the spirit and scope of the invention. Thus, this invention is not intended to be limited to the embodiments shown, but is to be accorded the widest scope consistent with the principles and features disclosed herein.

The invention claimed is:

1. A device for packaging and dispensing products, comprising a first container for a first product, at least one second container designed to be assembled removably to the first container, the second container comprising an opening that extends in a horizontal plane that is perpendicular to a geometric longitudinal axis of the first and second containers, and a product applicator assembled removably to the second container so as to close off said opening, wherein the product applicator is assembled in such a way that it can move transversely with respect to the geometric longitudinal axis of the first and second containers so as to remain within a single plane over an entire motion from a closed position to an open position, and wherein the product applicator completely closes off said opening in said closed position and the product applicator is entirely removed from the second container in said open position.

2. The device according to claim 1, wherein the second container comprises a compartmentalized body delimiting a first compartment and a second compartment, which are juxtaposed, the first compartment being designed to contain a second product, and wherein the opening that extends in the horizontal plane that is perpendicular to the geometric longitudinal axis of the first and second containers is a first opening of the second container, the second container having a second opening extending in a plane perpendicular to the plane of the first opening so as to receive an applicator element of the product applicator.

3. The device according to claim 1, further comprising a compartmentalized body which is designed to be assembled removably to the first container and which comprises a first part in which the or each second container is or are made, and a second part in which the or each second container open(s) out and which comprises a housing for the product applicator, and a cover which can move with respect to the body between an open position in which the product applicator is accessible from the outside and a closed position, and a closure for the cover.

4. The device according to claim 3, wherein the product applicator and a base of the housing comprise complementary structure for holding the product applicator in the second part, comprising at least one stud provided in the cover and at least one corresponding hole in the product applicator, in which the stud engages when the cover is closed.

5. The device according to claim 4, wherein the complementary structure for holding the product applicator comprises a stud and a recess, one provided in the base of the second part and the other in the product applicator.

6. The device according to claim 1, wherein the product applicator includes a handle that bears an applicator element, and wherein the applicator element is assembled removably to the second container such that the handle of the applicator element directly faces said opening of the second container.

7. The device according to claim 1, wherein the product applicator includes a handle that bears an applicator element, and wherein the applicator element is assembled removably to the second container such that a second product is directly exposed to the handle of the applicator element when said second product is contained in the second container.

8. The device according to claim 1, wherein second container includes first and second compartments, wherein the first compartment includes the opening that extends in the horizontal plane, and the second compartment includes an opening that extends in a vertical plane that is parallel to the geometric longitudinal axis of the first and second containers.

9. The device according to claim 8, wherein the product applicator is assembled to the second container such that, in the closed position, the product applicator extends through the opening of the second compartment and an applicator element of the product applicator is housed within the second compartment.

10. The device according to claim 8, wherein the first and second compartments are arranged side by side, wherein the second container includes a stepped upper end surface which delimits a first step and a second step, and wherein the first step and the second step are separated by the opening of the second compartment.

11. The device according to claim 1, wherein said single plane is the horizontal plane of the opening of the second container.

12. The device according to claim 1, wherein said single plane is inclined relative to the horizontal plane of the opening of the second container.

13. The device according to claim 1, wherein said second container contains a second product.

14. The device according to claim 13, wherein said second product is accessible through said opening of said second container when the product applicator is in the open position.

15. A method for applying make-up contained in a device as claimed in claim 1, comprising applying a product contained in the second container by opening the second container and applying said product using the product applicator, and applying a first product contained in the first container by opening the first container and applying said first product, wherein the second container is opened by moving the product applicator by sliding it transversely with respect to a geometric longitudinal axis of the first and second containers.

* * * * *